US011124332B2

(12) United States Patent
Yang

(10) Patent No.: US 11,124,332 B2
(45) Date of Patent: Sep. 21, 2021

(54) RING-PEEL-SEAL LINER

(71) Applicant: YNB SUPPLY (ASIA) CORPORATION, New Taipei (TW)

(72) Inventor: Yen-Wu Yang, New Taipei (TW)

(73) Assignee: YNB SUPPLY (ASIA) CORPORATION, New Taipei (TW)

( * ) Notice: Subject to any disclaimer, the term of this patent is extended or adjusted under 35 U.S.C. 154(b) by 50 days.

(21) Appl. No.: 16/655,287

(22) Filed: Oct. 17, 2019

(65) Prior Publication Data

US 2020/0122897 A1 Apr. 23, 2020

(30) Foreign Application Priority Data

Oct. 19, 2018 (CN) ..... 201811220770.1

(51) Int. Cl.
*B65D 33/20* (2006.01)

(52) U.S. Cl.
CPC ..... *B65D 33/20* (2013.01)

(58) Field of Classification Search
CPC ..... B65D 33/20; B65D 33/22; B65D 33/18; B65D 77/2028; B65D 77/2024; B65D 77/20; B65D 17/502; B65D 17/501
USPC ..... 220/359.2, 359.3, 359.1; 215/232
See application file for complete search history.

(56) References Cited

U.S. PATENT DOCUMENTS 3,312,368 A * 4/1967 Reynolds ..... B65D 17/502 220/359.2
3,355,059 A * 11/1967 Balocca ..... B65D 17/505 220/265
3,389,827 A * 6/1968 Abere ..... B65D 17/505 220/359.1
3,896,965 A * 7/1975 Cornell ..... B65D 17/502 220/359.2
4,934,544 A * 6/1990 Han ..... B65D 51/20 215/232
5,125,529 A * 6/1992 Torterotot ..... B65D 77/206 215/232
2016/0009447 A1* 1/2016 Rhue ..... B65D 43/02 220/359.2

* cited by examiner

*Primary Examiner* — Robert J Hicks
(74) *Attorney, Agent, or Firm* — Schmeiser, Olsen & Watts, LLP

(57) ABSTRACT

A ring-peel-seal liner is revealed, the ring-peel-seal liner includes a metal sealing layer and an adhesive layer. The metal sealing layer has a first annular tear line, and is defined into an annular region and a central region by the first annular tear line, wherein the annular region encircles the central region. The adhesive layer is adhered on one surface of the metal sealing layer. With the ring-peel-seal liner described above, the issue of needing an additional liner for enhancing a sealing effect after opening a conventional packaging container is resolved.

6 Claims, 3 Drawing Sheets

RING-PEEL-SEAL LINER

CROSS-REFERENCE TO RELATED APPLICATION

This non-provisional application claims priority under 35 U.S.C. § 119(a) on Patent Application No(s). 201811220770.1 filed in China on Oct. 19, 2018, the entire contents of which are hereby incorporated by reference.

BACKGROUND OF THE INVENTION

Field of the Invention

The present invention relates to a ring-peel-seal liner, and more particularly to a resealable ring-peel-seal liner after a seal is opened.

Description of the Prior Art

Openings of commercial packaging containers, for example, packaging containers with contents such as foods, pharmaceutical products, chemical solvents and cosmetics, usually involve sealing container openings by using sealing films. With the design of the sealing film, the contents in the packaging containers can be prevented from qualitative change of the contents caused by coming into contact with the exterior.

On the other hand, when a sealing film is destructed as a user takes out contents from a packaging container, if the contents in the packaging container are not consumed all at once but some of the contents remain in the packaging container, the sealing effect of a lid is still less satisfactory than that of the original sealing film even if the opening of the packaging container is covered by the lid. In order to enhance the sealing effect of an opened packaging container, a conventional approach is to add a sealing liner on an inner surface of a lid of a packaging container. Thus, when a user covers the opening of the packaging container by the lid, the sealing liner exactly presses about the opening of the packaging container, further achieving a sealing effect similar to that of a sealing film before the packaging container is opened.

SUMMARY OF THE INVENTION

However, in a conventional packaging container, in order to provide the packaging container with a sealing effect after the packaging container is opened, an additional sealing liner needs to be further manufactured, in a way that complexities as well as material consumption of production processes are increased.

It is an object of the present invention to provide a ring-peel-seal liner with respect to the issues above. The ring-peel-seal liner includes: a metal sealing layer, having a first annular tear line, and defined into an annular region and a central region by the first annular tear line, wherein the annular region encircles the central region; and an adhesive layer, adhered on one surface of the metal sealing layer.

The ring-peel-seal liner above further includes a pull piece, of which one end is connected to the central region of the metal sealing layer.

In the ring-peel-seal liner above, the pull piece is a ring, round or polygon.

The ring-peel-seal liner above further includes an auxiliary tear line located in the central region of the metal sealing layer, and one end of the auxiliary tear line is connected to the first annular tear line.

The ring-peel-seal liner above further includes a reinforcement layer adhered on the other surface of the metal sealing layer opposite to the adhesive layer. The reinforcement layer has a second annular tear line, and the position of the second annular tear line vertically overlaps with the position of the first annular tear line.

The ring-peel-seal liner above further includes a first auxiliary tear line and a second auxiliary tear line. The first auxiliary tear line is located within the central region of the metal sealing layer, and one end of the first auxiliary tear line is connected to the first annular tear line. The second auxiliary tear line is located within the second annular tear line of the reinforcement layer, and one end of the second auxiliary tear line is connected to the second annular tear line. The position of the second auxiliary tear line vertically overlaps with the position of the first auxiliary tear line.

The ring-peel-seal liner above further includes a pull piece, which is connected to a central region of the reinforcement layer.

In the ring-peel-seal liner above, a through hole is present at the center of the reinforcement layer, the pull piece is located in the through hole, and one end of the pull piece is connected to annular edge of the through hole defined by the reinforcement layer.

The ring-peel-seal liner above further includes a first auxiliary tear line and a second auxiliary tear line. The first auxiliary tear line is located within the central region of the metal sealing layer, and one end of the first auxiliary tear line is connected to the first annular tear line. The second auxiliary tear line is located within the second annular tear line of the reinforcement layer, and one end of the second auxiliary tear line is connected to the second annular tear line. The position of the second auxiliary tear line vertically overlaps with the position of the first auxiliary tear line.

In the ring-peel-seal liner above, the other end of the second auxiliary tear line extends to a joint of the pull piece and the annular edge of the reinforcement layer.

With the ring-peel-seal liner above, the issue of needing an additional liner for enhancing a sealing effect after opening a conventional packaging container can be resolved.

DETAILED DESCRIPTION OF THE EMBODIMENTS

To fully understand the objects, features and effects of the present invention, details of the present invention are given in the following specific embodiments with the accompanying drawings below.

Figure 1:
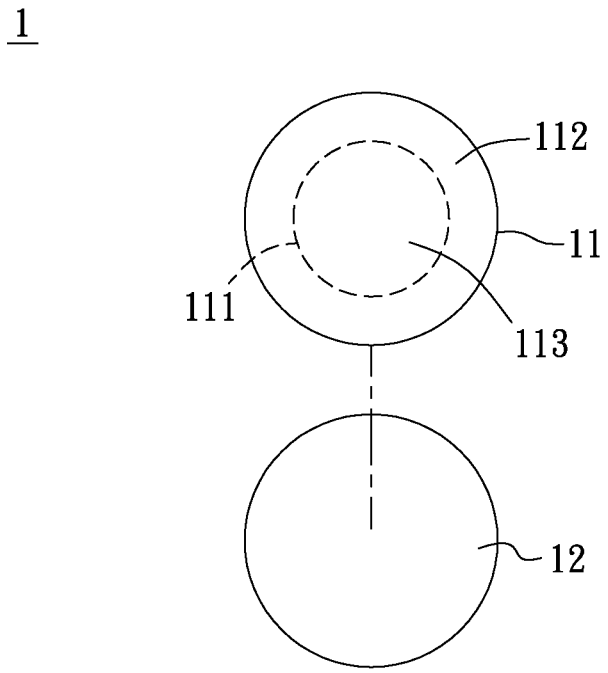
FIG. 1 is an exploded schematic diagram of a ring-peel-seal liner according to a first embodiment of the present invention.

A ring-peel-seal liner 1 is provided according to a first embodiment of the present invention. Referring to FIG. 1, the ring-peel-seal liner 1 includes a metal sealing layer 11 and an adhesive layer 12. The metal sealing layer 11, made of an aluminum-plastic composite material, has a first annular tear line 111, and is defined into an annular region 112 and a central region 113 by the first annular tear line 111, wherein the annular region 112 encircles the central region 113. The adhesive layer 12 is adhered on one surface of the metal sealing layer 11. With the configuration above, during an opening sealing process (not shown) of a packaging container, the ring-peel-seal liner 1 can be used to cover the opening of the packaging container, and the packaging container covered by the ring-peel-seal liner 1 is placed into an electromagnetic induction sealing machine (not shown). Since the aluminum in the metal sealing layer 11 is an electrically conductive material, with the electromagnetic induction applied by the electromagnetic induction sealing machine on the metal sealing layer 11, an electric current flow is generated in the aluminum in the metal sealing layer 11 and heat energy is generated, such that the heated metal sealing layer 11 can cause the adhesive layer 12 to become heated into a molten state, and the ring-peel-seal liner 1 is allowed to closely seal the opening of the packaging container by the adhesive layer 12 in a molten state. With the matching design of the metal sealing layer 11 and the adhesive layer 12 of the ring-peel-seal liner 1, the ring-peel-seal liner 1 can be used as a liner for sealing an opening of a container.

Meanwhile, using the design of the first annular tear line 111, when a user wishes to open the opening of a container sealed by the ring-peel-seal liner 1 in order to take out the contents from the packaging container, instead of having to completely destruct the ring-peel-seal liner 1, the user can tear along the first annular tear line 111 to remove the central region 113 of the metal sealing layer 11, while the annular region 112 keeps sealing the edge of the opening of the container, and a through hole formed after the central region 113 is removed along the first annular tear line 111 can be used for the user to take out the contents. When the user has finished taking out the required contents and some of the contents still remain in the packaging container, the user can cover the container opening by a common lid (not shown). With fitting between an inner surface of the lid and the annular region 112 of the metal sealing layer 11, the peripheral area of the container opening is sealed by the annular region 112, and the through hole at the center of the annular region 112 is sealed by the inner surface of the lid. Thus, external substances in the environment cannot enter inside the container through the opening of the container, and the contents in the container cannot come into contact with the external environment, thereby providing the packaging container with a sealing effect similar to that before the container opening is opened, without having to additionally manufacture a liner for assisting sealing a lid in covering the container opening. With the above configuration of the ring-peel-seal liner 1, the issue of needing an additional liner for enhancing a sealing effect after opening a conventional packaging container can be resolved.

In the first embodiment, the material of the metal sealing layer 11 is an aluminum-plastic composite material. However, in other embodiments, the material of the metal sealing layer 11 can be selected from other metal materials such as iron, copper and silver, and is not limited to the example given in the first embodiment.

In the first embodiment, the material of the adhesive layer 12 is polyethylene. However, in other embodiments, the material of the adhesive layer 12 can be selected from a group consisting of polyethylene terephthalate, polypropylene, hot melt adhesive and polyolefin hot melt adhesive, or selected from a material the same as that of a container opening to be sealed, and is not limited to the example given in the first embodiment.

Figure 2:
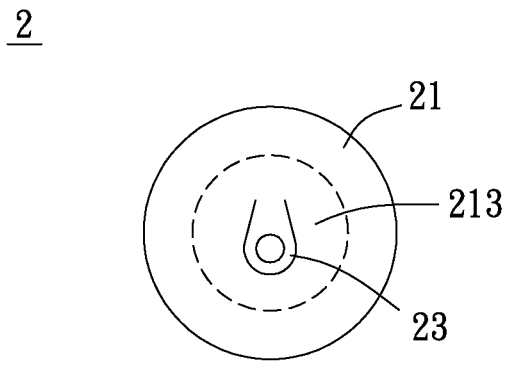
FIG. 2 is an appearance schematic diagram of a ring-peel-seal liner according to a second embodiment of the present invention.

A ring-peel-seal liner 2 is provided according to a second embodiment of the present invention. Referring to FIG. 2, the ring-peel-seal liner 2 of the second embodiment is substantially the same as the ring-peel-seal liner 1 of the first embodiment, and primarily differs in that, the ring-peel-seal liner 2 further includes a pull piece 23, which is connected to a central region 213 of a metal sealing layer 21. With the design of the pull piece 23, a user is allowed to pull up and tear off the central region 213 of the metal sealing layer 21 by pinching the pull piece 23, thereby more easily remove the central region 213 of the metal sealing layer 21.

In the second embodiment, the pull piece 23 is appears as a ring in shape; that is, the pull piece 23 is a pull ring structure. However, in other embodiments, the pull piece 23 may be quadrilateral, pentagonal or triangular in shape, or be a round or polygon, and is not limited to the example given in the second embodiment. In the second embodiment, the pull piece 23 and the metal sealing layer 21 are in a design of a formed integral. However, in other embodiments, the pull piece 23 can be designed as a separate plate and being connected to the metal sealing layer 21.

Figure 3:
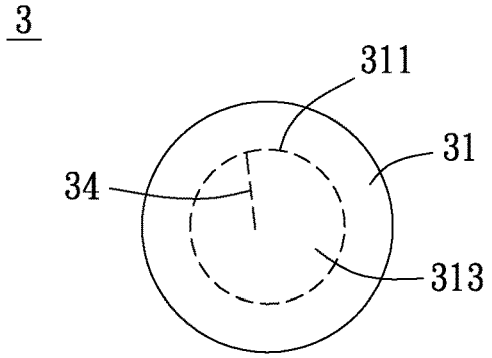
FIG. 3 is an appearance schematic diagram of a ring-peel-seal liner according to a third embodiment of the present invention.

A ring-peel-seal liner 3 is provided according to a third embodiment of the present invention. Referring to FIG. 3, the ring-peel-seal liner 3 of the third embodiment is substantially the same as the ring-peel-seal liner 1 of the first embodiment, and primarily differs in that, the ring-peel-seal liner 3 further includes an auxiliary tear line 34. The auxiliary tear line 34 is located within a central region 313 of a metal sealing layer 31, and one end of the auxiliary tear line 34 is connected to a first annular tear line 311. With the configuration above, when a user wishes to remove the central region 313 of the ring-peel-seal liner 3, the user can first tear off a part of the central region 313 along the auxiliary tear line 34 and then pinch the torn part of the central region 313 to tear off the entire central region 313 around the first annular tear line 311 from the ring-peel-seal liner 3. With the configuration of the auxiliary tear line 34, a user is allowed to more easily remove the central region 313 from the ring-peel-seal liner 3.

Figure 4:
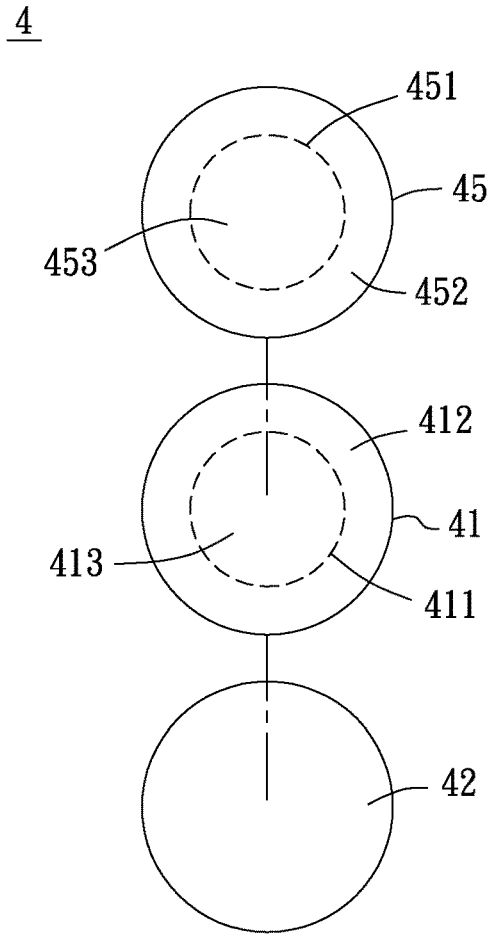
FIG. 4 is an exploded schematic diagram of a ring-peel-seal liner according to a fourth embodiment of the present invention.

A ring-peel-seal liner 4 is provided according to a fourth embodiment of the present invention. Referring to FIG. 4, the ring-peel-seal liner 4 of the fourth embodiment is substantially the same as the ring-peel-seal liner 1 of the first embodiment, and primarily differs in that, the ring-peel-seal liner 4 further includes a reinforcement layer 45. The reinforcement layer 45 is adhered on the other surface of a metal sealing layer 41 opposite to an adhesive layer 42, and has a second annular tear line 451. The second annular tear line 451 similarly defines the reinforcement layer 45 into an annular region 452 and a central region 453, and the position of the second annular tear line 451 vertically overlaps the position of the first annular tear line 411. The reinforcement layer 45 is used for further reinforcing the structures of the metal sealing layer 41 and the adhesive layer 42. With the second annular tear line 451 of the reinforcement layer 45 provided correspondingly to the metal sealing layer 41, the central region 413 of the metal sealing layer 41 and the central region 453 of the reinforcement layer 45 are simultaneously torn of, such that an annular region 412 of the metal sealing layer 41 and the annular region 452 of the reinforcement layer 45 can maintain the state of sealing around the container opening; that is, while the overall structure of the ring-peel-seal liner 4 is strengthened, the original configuration purpose of the ring-peel-seal liner 4 is left unaffected.

In the fourth embodiment, the reinforcement layer 45 is made of a polyethylene foam material. However, in other embodiments, the material of the reinforcement layer 45 can be selected from a group consisting of polyethylene, a polypropylene foam material and a non-foam material, or other materials known to be suitable for reinforcing the structure of a ring-peel-seal liner, and is not limited to the example given in the fourth embodiment.

Figure 5:
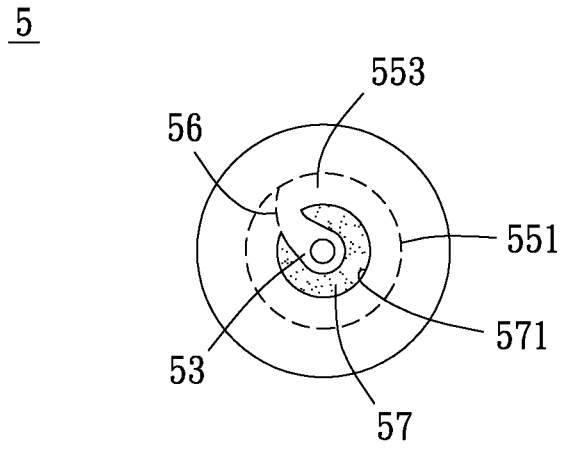
FIG. 5 is an appearance schematic diagram of a ring-peel-seal liner according to a fifth embodiment of the present invention.
Figure 6:
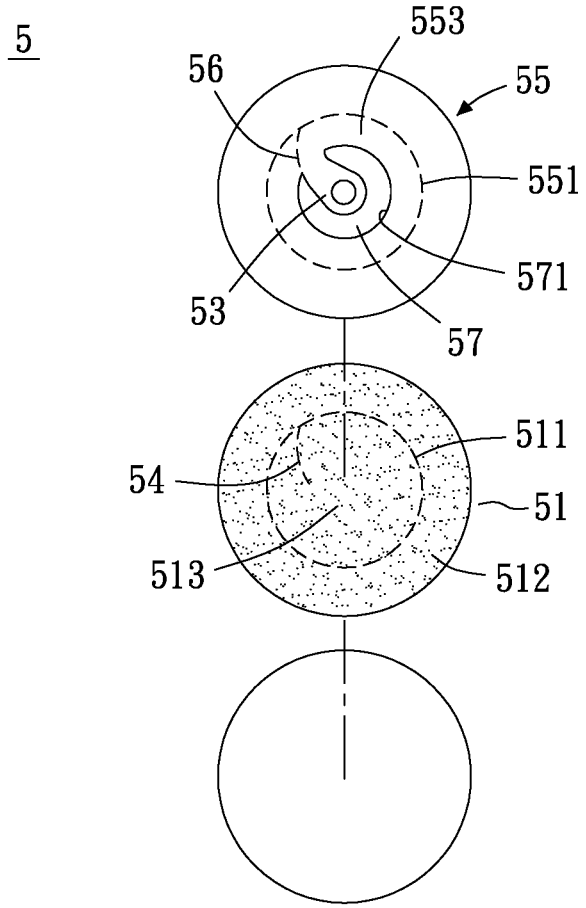
FIG. 6 is an exploded schematic diagram of a ring-peel-seal liner according to the fifth embodiment of the present invention.

A ring-peel-seal liner 5 is provided according to a fifth embodiment of the present invention. Referring to FIG. 5 and FIG. 6, the ring-peel-seal liner 5 of the fifth embodiment is substantially the same as the ring-peel-seal liner 4 of the fourth embodiment, and primarily differs in that, the ring-peel-seal liner 5 includes a first auxiliary tear line 54 and a second auxiliary tear line 56. The first auxiliary tear line 54 is located within a central region 513 of a metal sealing layer 51, and one end of the first auxiliary tear line 54 is connected to a first annular tear line 511. The second auxiliary tear line 56 is located within a central region 553 of a reinforcement layer 55, and one end of the second auxiliary tear line 56 is connected to a second annular tear line 551. The position of the second auxiliary tear line 56 vertically overlaps with the position of the first auxiliary tear line 54. With the configuration above, similar to the principle of the reinforcement layer 45 of the fourth embodiment, while the overall structure of the ring-peel-seal liner 5 is strengthened, a user can still easily remove the central region 513 and the central region 553 from the ring-peel-seal liner 5.

Meanwhile, the ring-peel-seal liner 5 further includes a pull piece 53, and a through hole 57 is further present in the central region 553 of the reinforcement layer 55. The pull piece 53 is located in the through hole 57 and is not adhered to the metal sealing layer 51; that is, one end of the pull piece 53 can be lifted from the through hole 57. One end of the pull piece 53 is connected to an annular edge 571 of the through hole 57 defined by the reinforcement layer 55, and the other end of the second auxiliary tear line 56 extends to a joint of the pull piece 53 and the annular edge 571 of the reinforcement layer 55. With the configuration above, when a user wishes to simultaneously tear off the central region 513 of the metal sealing layer 51 and the central region 553 of the reinforcement layer 55, only the pull piece 53 needs to be pulled up, and using a method similar to those for tearing off the central region of the metal sealing layer and the central region of the reinforcement layer of the fourth embodiment and the fifth embodiment, the central region 513 of the metal sealing layer 51 and the central region 553 of the reinforcement layer 55 can be removed. Due to the pull piece 53, the user is allowed to open the ring-peel-seal liner 5 with a reduced effort. In addition, because the pull piece 53 is located in the through hole 57 and is kept in a flatly adhered state, the volume of the ring-peel-seal liner 5 is not additionally increased.

In conclusion, the ring-peel-seal liner above is capable of resolving the issue of needing an additional liner for enhancing a sealing effect after opening a conventional packaging container. Meanwhile, with the design of the reinforcement layer of the ring-peel-seal liner, the overall structural strength of the ring-peel-seal liner can be strengthened. Further, with the design of the auxiliary tear lines and the pull piece, the effort needed for opening the ring-peel-seal liner can be reduced for the user.

While the invention has been described by way of the preferred embodiments, a person skilled in the art should understand that the embodiments are for illustrating the present invention and are not to be construed as limitations to the scope of the present invention. It should be noted that, equivalent modifications and substitutions made to the embodiments are to be encompassed within the scope of the present invention. Therefore, the scope of present invention should be accorded with the appended claims.

What is claimed is:

1. A ring-peel-seal liner, comprising:

a metal sealing layer, having a first annular tear line, the metal sealing layer defined into an annular region and a central region by the first annular tear line, the annular region encircling the central region; and an adhesive layer, adhered on one surface of the metal sealing layer;

a reinforcement layer, adhered on one other surface of the metal sealing layer opposite to the adhesive layer, the reinforcement layer having a second annular tear line;

wherein, a position of the second annular tear line vertically overlaps with a position of the first annular tear line;

a pull piece, connected to the central region of the reinforcement layer;

wherein a through hole is present at a center of the reinforcement layer, the pull piece is located in the through hole, and one end of the pull piece is connected to an annular edge of the through hole defined by the reinforcement layer.

2. The ring-peel-seal liner according to claim 1, further comprising:

the pull piece having one end thereof connected to the central region of the metal sealing layer.

3. The ring-peel-seal liner according to claim 2, wherein the pull piece is a ring, round or polygon.

4. The ring-peel-seal liner according to claim 1, further comprising:

an auxiliary tear line, located within the central region of the metal sealing layer, having one end thereof connected to the first annular tear line.

5. The ring-peel-seal liner according to claim 1, further comprising:

a first auxiliary tear line and a second auxiliary tear line;

wherein, the first auxiliary tear line is located within the central region of the metal sealing layer, one end of the first auxiliary tear line is connected to the first annular tear line, the second auxiliary tear line is located within the second annular tear line of the reinforcement layer, one end of the second auxiliary tear line is connected to the second annular tear line, and a position of the second auxiliary tear line vertically overlaps with a position of the first auxiliary tear line.

6. The ring-peel-seal liner according to claim 5, wherein one other end of the second auxiliary tear line extends to a joint of the pull piece and the annular edge of the reinforcement layer.

* * * * *